US011493295B1

(12) United States Patent
Broadnax et al.

(10) Patent No.: US 11,493,295 B1
(45) Date of Patent: Nov. 8, 2022

(54) TAMPER-ACTUATED FLUID RELEASE FIREARM INTERLOCK

(71) Applicant: Charles L. Broadnax, Converse, TX (US)

(72) Inventors: Charles L. Broadnax, Converse, TX (US); Boris Bass, Spring, TX (US)

(73) Assignee: Charles L. Broadnax, Converse, TX (US)

( * ) Notice: Subject to any disclaimer, the term of this patent is extended or adjusted under 35 U.S.C. 154(b) by 0 days.

(21) Appl. No.: 17/456,484

(22) Filed: Nov. 24, 2021

Related U.S. Application Data

(60) Provisional application No. 63/203,107, filed on Jul. 8, 2021.

(51) Int. Cl.

| | |
|---|---|
| ***F41A 17/44*** | (2006.01) |
| ***F41C 33/02*** | (2006.01) |
| ***F41A 17/06*** | (2006.01) |
| ***F41A 17/30*** | (2006.01) |

(52) U.S. Cl.
CPC ..... *F41A 17/44* (2013.01); *F41A 17/066* (2013.01); *F41A 17/30* (2013.01); *F41C 33/0263* (2013.01)

(58) Field of Classification Search
CPC ..... F41A 17/44
See application file for complete search history.

(56) References Cited

U.S. PATENT DOCUMENTS

| | | | | |
|---|---|---|---|---|
| 2,327,334 A | | 8/1943 | Camille | |
| 2,664,658 A | | 1/1954 | Tex | |
| 3,462,869 A | | 8/1969 | Wallace | |
| 3,605,311 A | * | 9/1971 | Hermann | F41A 17/44 42/70.11 |
| 3,634,963 A | * | 1/1972 | Hermann | F41A 17/44 42/70.11 |
| 3,765,115 A | | 10/1973 | Johansson et al. | |
| 4,136,475 A | | 1/1979 | Centille | |
| 4,384,420 A | | 5/1983 | Muller | |
| 4,483,501 A | | 11/1984 | Eddy | |

(Continued)

FOREIGN PATENT DOCUMENTS

| | | | | |
|---|---|---|---|---|
| DE | 202010000924 U1 | * | 6/2011 | F41A 17/44 |
| EP | 1469274 A1 | | 10/2004 | |

(Continued)

*Primary Examiner* — Gabriel J. Klein
(74) *Attorney, Agent, or Firm* — Craige Thompson; Thompson Patent Law; Timothy D. Snowden

(57) ABSTRACT

Apparatus and associated methods relate to a firearm lock configured to release a self-hardening interlock fluid into a firing chamber of a firearm in response to a predetermined force. In an illustrative example, the firearm lock may include an engagement module configured to releasably couple to a firing chamber of the firearm. In a locked mode, for example, the engagement module may prevent the firearm from firing. The firearm lock may include, for example, a tamper interlock module containing interlock material (IM) in a fluid state. When a predetermined force is applied to the tamper interlock module, for example, the IM may be dispensed from the cavity into the firing chamber and the IM may at least partially transition into a solid state such that the IM prevents the firearm from firing. Various embodiments may advantageously disable a locked firearm in response to tampering with the lock.

6 Claims, 14 Drawing Sheets

(56) References Cited

U.S. PATENT DOCUMENTS 4,532,729 A 8/1985 Muller
4,644,676 A 2/1987 Stern
5,042,185 A 8/1991 Justice
5,048,212 A 9/1991 Mossberg
5,138,786 A 8/1992 Fischer
5,140,766 A 8/1992 Brooks
5,229,532 A 7/1993 Brooks
5,233,777 A 8/1993 Waterman, Jr. et al.
5,235,763 A 8/1993 Nosler et al.
5,361,525 A 11/1994 Bowes
5,417,000 A 5/1995 Chen
5,419,069 A * 5/1995 Mumbleau ..... F41A 17/02 42/70.11
5,669,252 A * 9/1997 Bentley ..... F41A 17/44 42/70.11
5,768,819 A 6/1998 Neal
5,782,028 A 7/1998 Simon et al.
5,987,796 A 11/1999 Brooks
6,041,536 A 3/2000 Samuels et al.
6,122,851 A 9/2000 Perkins
6,125,568 A 10/2000 Granaroli
6,230,946 B1 * 5/2001 Vor Keller ..... F41A 17/066 224/244
6,260,300 B1 7/2001 Klebes et al.
6,347,538 B1 2/2002 Doiron
6,385,890 B1 5/2002 Amadini
6,405,471 B1 6/2002 Mauch
6,442,880 B1 9/2002 Allan
6,474,011 B1 11/2002 Sato
6,487,804 B1 12/2002 Petrella, Jr.
6,499,244 B1 * 12/2002 Smith ..... F41A 17/44 42/70.11
6,510,639 B2 1/2003 McMoore
6,591,532 B1 * 7/2003 Gilbertson ..... F41A 17/42 42/70.11
6,615,528 B1 * 9/2003 Lindskog ..... F41A 17/44 42/70.01
6,755,054 B2 6/2004 Burmesch et al.
6,775,941 B1 8/2004 McNulty, Jr.
6,796,071 B2 9/2004 Lane et al.
6,843,013 B2 1/2005 Cutini et al.
6,851,213 B1 2/2005 Doiron
6,874,265 B1 4/2005 Pathak
6,918,519 B2 7/2005 Keller et al.
6,941,692 B1 9/2005 Krinke et al.
6,990,905 B1 1/2006 Manole et al.
7,140,139 B2 11/2006 Markbreit et al.
7,225,575 B2 6/2007 Kiesel et al.
7,543,403 B1 6/2009 Schaefer
7,591,402 B2 9/2009 Rassias
7,600,340 B2 10/2009 Curry et al.
7,694,860 B2 4/2010 Clifton, Jr.
7,966,759 B2 6/2011 Bentley
8,087,551 B2 * 1/2012 Henley, II ..... F41A 13/04 222/386
8,207,816 B2 6/2012 Crigger et al.
8,235,263 B1 8/2012 Yeates et al.
8,418,391 B2 4/2013 Kemmerer et al.
8,881,443 B2 11/2014 Westwood et al.
9,050,433 B2 6/2015 Lamble et al.
9,175,925 B2 11/2015 Pellegrini
9,222,742 B2 12/2015 Steuwer et al.
9,605,919 B2 3/2017 Wengender
9,766,037 B2 9/2017 Irwin
10,072,904 B2 9/2018 Binns
10,309,740 B2 6/2019 Fishbein et al.
10,365,057 B2 7/2019 Black et al.
10,571,209 B1 * 2/2020 Dagan ..... F41A 17/44
11,022,392 B2 6/2021 Wallgren
11,029,112 B2 6/2021 Weiss
2001/0033228 A1 10/2001 Kisreman et al.
2002/0069568 A1 6/2002 Bowles
2003/0066228 A1 4/2003 Smith
2006/0208857 A1 9/2006 Wong
2007/0175935 A1 8/2007 Clifton
2008/0047187 A1 2/2008 Ramsey
2008/0134556 A1 6/2008 Remelin
2008/0179359 A1 7/2008 Aberle et al.
2009/0321480 A1 12/2009 Kincaid et al.
2012/0131829 A1 5/2012 Fistikchi et al.
2013/0061502 A1 3/2013 Derman
2013/0075435 A1 3/2013 Hellweg
2013/0160343 A1 6/2013 Higgins
2014/0291363 A1 10/2014 Clifton, Jr.
2016/0047616 A1 * 2/2016 Giebel ..... F41A 17/64 42/70.01
2016/0252317 A1 9/2016 Biran et al.
2017/0010062 A1 * 1/2017 Black ..... F41A 17/063
2017/0191775 A1 7/2017 Bibee et al.
2017/0241730 A1 8/2017 Ochoa
2017/0248383 A1 * 8/2017 McLean, III ..... F41A 17/063
2018/0066910 A1 3/2018 Biran
2020/0141693 A1 * 5/2020 Rassias ..... F41C 33/041
2021/0215454 A1 7/2021 Gregory et al.

FOREIGN PATENT DOCUMENTS

EP 1586851 A1 10/2005
EP 2122291 B1 6/2010
RU 300737 A1 7/2000
RU 2232962 C1 7/2004
WO 2018127934 A1 7/2018

* cited by examiner

TAMPER-ACTUATED FLUID RELEASE FIREARM INTERLOCK

CROSS-REFERENCE TO RELATED APPLICATIONS

This application claims the benefit of U.S. Application Ser. No. 63/203,107, titled "Ammunition Insertion Interlocking Magazine," filed by Charles Broadnax on Jul. 8, 2021.

This application incorporates the entire contents of the foregoing application(s) herein by reference.

TECHNICAL FIELD

Various embodiments relate generally to firearm locks.

BACKGROUND

Defense tools may include handheld tools. Some handheld defense tools may include projectile launching tools. A firearm is a projectile launching tool. Firearms may, for example, be handheld. Firearms may be mounted (e.g., on a stand, on a ship, on a fortification). Firearms may be used for defense. Firearms may be used for recreation (e.g., target practice). Firearms may, for example, be used for food procurement (e.g., hunting).

A firearm may be configured to launch a self-contained projectile. For example, the projectile may be disposed in a cartridge with an ignitable material (e.g., gunpowder). A cartridge may include a single projectile. Some cartridges may include multiple projectiles.

Firearms may be designed to shoot one or more different calibers of projectiles. For example, many common single-projectile calibers are in a range of (nominal) diameters between about .20 and .50 inches. Other calibers may be used.

Firearms may come in various configurations. For example, handguns may be designed to be held in one or two hands. Handguns may include semi-automatic handguns. Handguns may include revolvers. Long guns may be designed to be braced against a user's trunk. For example, rifles and shotguns may be configured as long guns.

SUMMARY

Apparatus and associated methods relate to a firearm lock configured to release a self-hardening interlock fluid into a firing chamber of a firearm in response to a predetermined force. In an illustrative example, the firearm lock may include an engagement module configured to releasably couple to a firing chamber of the firearm. In a locked mode, for example, the engagement module may prevent the firearm from firing. The firearm lock may include, for example, a tamper interlock module containing interlock material (IM) in a fluid state. When a predetermined force is applied to the tamper interlock module, for example, the IM may be dispensed from the cavity into the firing chamber and the IM may at least partially transition into a solid state such that the IM prevents the firearm from firing. Various embodiments may advantageously disable a locked firearm in response to tampering with the lock.

Various embodiments may achieve one or more advantages. For example, some embodiments may prevent unauthorized operation of a firearm. In some embodiments a tamper interlock module may advantageously disable the firearm before an unauthorized user is able to remove the fluid firearm interlock (FFI).

Some embodiments may advantageously respond to geolocation signal(s) (e.g., GPS). In various embodiments, an FFI may advantageously operate between at least a locked mode and an unlocked mode in response to biometric input(s).

Various embodiments may be advantageously configured for one or more firearms. For example, some embodiments may advantageously be configured for a specific type of firearm. Some embodiments, by way of example and not limitation, may be configured to selectively lock a handgun (e.g., semi-automatic handgun). Some embodiments may be configured to interlock a long gun (e.g., rifle, shotgun).

Various embodiments may be advantageously configured for firearms of one or more calibers. For example, some embodiments may be advantageously configured for a range of calibers. Some embodiments may, for example, advantageously configured such that, by way of example and not limitation, between 3-10 different variants may advantageously fit 500 or more common firearms.

In some embodiments, interlock material may disable a firearm without permanently damaging the firearm. For example, a firearm owner may, for example, advantageously recover and restore the firearm without suffering permanent loss of the firearm. Such embodiments may, for example, advantageously increase compliance with using the FFI, such as by reducing fear of property loss due to an accidental activation of the TIM. Some embodiments may, for example, advantageously permit reuse of an FFI after activation of a TIM. For example, various embodiments may advantageously be removable (e.g., dissolvable, reversible) using a known chemical(s). The chemical(s) may, for example, advantageously be kept proprietary for safety purposes.

In some embodiments a firearm may advantageously be locked into a cooperatively interlocking holster (CIH) with an FFI. In some embodiments, for example, a CIH may advantageously protect an FFI from accidental damage and/or accidental activation (e.g., dropping, bumping). A firearm may, for example, advantageously be automatically operated into a lockable mode when a user holsters the firearm in a CIH.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, a fluid firearm interlock (FFI) system is introduced with reference to FIG. 1. A cooperatively interlocking holster (CIH) is introduced with reference to FIG. 2. Second, that introduction leads into a description with reference to FIGS. 3-6 of some exemplary embodiments of FFI. Third, with reference to FIG. 7, an exemplary electronic FFI is described. Fourth, with reference to FIGS. 8A-9G, the discussion turns to exemplary embodiments of CIHs. Fifth, and with reference to FIGS. 10-11, this document describes exemplary methods useful for firearm interlock. Finally, the document discusses further embodiments, exemplary applications and aspects relating to FFIs.

Figure 1:
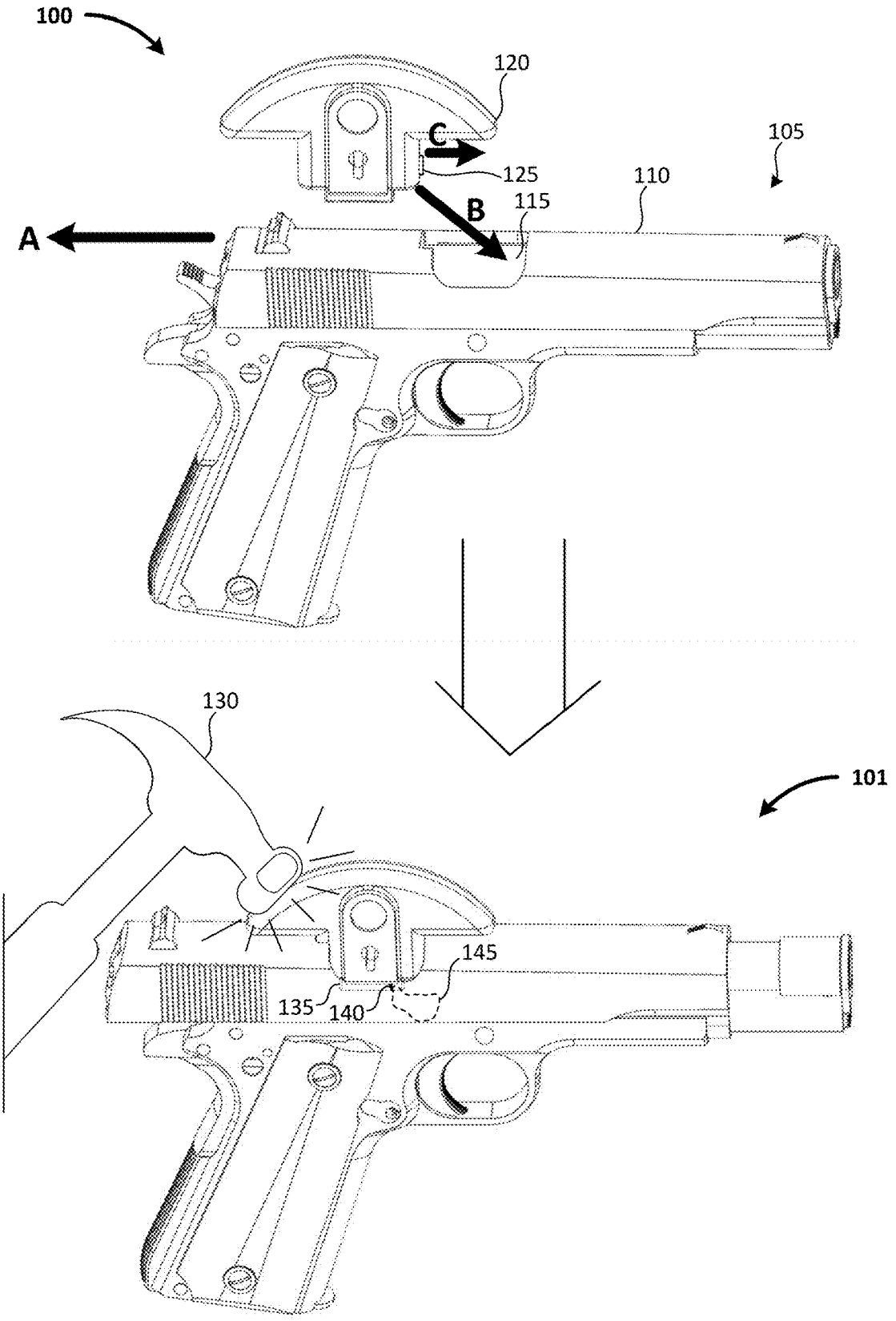
FIG. 1 depicts an exemplary fluid firearm interlock (FFI) system in an illustrative use-case scenario.

FIG. 1 depicts an exemplary fluid firearm interlock (FFI) system in an illustrative use-case scenario. In an unlocked mode 100, a firearm 105 includes a slide 110 having an ejection port 115. The slide 110 is slid ('racked') backwards (labeled as motion "A"), to expose a firing chamber of the firearm through the ejection port 115. An FFI 120 is brought into register with the firing chamber and inserted into the firing chamber via the ejection port 115, as shown in a locked mode 101. An engagement module may be operated to 'arm' the FFI 120. As depicted, a locking member 125 of the engagement module is extended (motion "C") into the barrel of the firearm 105 once the FFI 120 is inserted into the firing chamber. Accordingly, the FFI 120 may lock the slide 110 in a retracted position. For example, the FFI 120 may prevent a firing pin of the firearm 105 from activating a projectile. Accordingly, the FFI 120 may advantageously prevent unauthorized operation of the firearm 105.

When in the locked mode, an unauthorized user may, for example, seek to remove the FFI 120 from the firearm 105. As depicted, for example, a miscreant may apply a destructive device 130 (e.g., hammer) to the FFI 120, such as in an attempt to gain unauthorized access to the firearm 105. In the locked mode 101, in the depicted example, a tamper interlock module (TIM 135) is disposed (as shown by dashed lines) within the firing chamber of the firearm 105. The TIM 135 may be constructed to selectively dispense interlock material into the firearm 105 when the FFI 120 is (destructively) tampered with.

As depicted, for example, when the destructive device 130 is used to strike the FFI 120, an aperture 140 is opened in the TIM 135, dispensing interlock material 145 into the firearm 105. The interlock material 145 may, for example, include a phase-changing material. For example, the interlock material 145 may be stored and/or dispensed in a liquid form. The material may transition at least partially into a solid form upon and/or after being dispensed from the TIM 135 into the firearm 105. For example, the interlock material 145 may solidify in and/or about working mechanism(s) of the firearm 105 such that the firearm 105 is rendered at least temporarily inoperable. Accordingly, the TIM 135 may advantageously disable the firearm 105 before an unauthorized user is able to remove the FFI 120.

In some embodiments, the interlock material 145 may disable the firearm 105 without permanently damaging the firearm 105. Accordingly, a firearm owner may, for example, advantageously recover and restore the firearm 105 without suffering permanent loss of the firearm 105. Such embodiments may, for example, advantageously increase compliance with using the FFI 120 because firearm owners desire the safety of the FFI 120 without fearing permanent disablement of their firearm 105 (e.g., due to a false alarm).

As an illustrative example, in various embodiments such as described herein, the interlock material 145 may include a phase-changing liquid, such as a multi-part liquid (e.g., resin and hardener). When a predetermined level of force is applied to the FFI 120, the TIM 135 may dispense the parts of the interlock material 145 such that that they mix together and initiate a chemical reaction. The chemical reaction may induce a phase change from, for example, liquid to solid. The phase change may 'freeze' a moving part of the firearm 105. For example, some embodiments may interfere with operation of a firing pin against a projectile (e.g., obstruct motion of the firing pin, physically separate the firing pin from the projectile). Some embodiments may, for example, interfere with motion of the slide 110, such as relative to the barrel. Some embodiments may, by way of example and not limitation, interfere with operation of a trigger and/or hammer mechanism.

In some embodiments, an interlock material may, by way of example and not limitation, include an air-activated fluid. For example, when the interlock material 145 is dispensed from the TIM 135, exposure to air may initiate a phase transition.

In some embodiments, an interlock material may, for example, include heat activated fluid. For example, when the interlock material 145 is dispensed from the TIM 135, a thermal module (not shown) may be activated (e.g., simultaneously) such that the thermal module brings at least some of the interlock material 145 within a predetermined temperature range (e.g., by heating, cooling).

In various embodiments, an interlock material may, for example, include light sensitive material. As an illustrative example, a photopolymeric material may be dispensed from the TIM 135. A light module (not shown) may, for example, be activated (e.g., simultaneously) when the interlock material 145 is dispensed. The light module may, for example, emit a (predetermined spectrum of) light such that photopolymerization is induced in the interlock material 145. The photopolymerization may induce a phase change in the interlock material 145.

In the depicted example, the aperture 140 is configured to selectively fail in response to a predetermined range of tampering. As depicted, a wall of the TIM 135 defines a chamber holding the interlock material 145. The wall of the TIM 135 fails in response to impact from the destructive device 130. Failure of the wall creates an aperture 140, such that the interlock material 145 is dispensed from the aperture 140.

In some embodiments, the TIM 135 may be configured to dispense the interlock material 145 in response to a predetermined tamper attribute. The tamper attribute may include, by way of example and not limitation, a (predetermined) minimum force. For example, the minimum force may correspond to an impact force. In some embodiments, the minimum force may, for example, correspond to a minimum pressure (e.g., such as applied by prying).

In some embodiments, the tamper attribute may, for example, correspond to vibration. For example, a minimum vibration level may be selected to correspond to filing of the FFI 120 (e.g., scraping the FFI 120 on concrete, grinding the FFI 120 with an electric grinder).

The TIM 135 may, for example, be statically responsive to the predetermined tamper attribute. For example, at least some portion of the wall of the TIM 135 may be configured to fail in response to the tamper attribute(s). The TIM 135 may, for example, include a predefined stress region(s). The wall may selectively fail along at least some portion of the predefined stress region(s) in response to a tamper attribute.

In some embodiments, a structure(s) internal to the TIM 135 may be responsive to the tamper attribute(s). For example, an internal divider and/or chamber (e.g., satchel) may fail in response the TIM 135. The internal divider and/or chamber may permit mixing of multiple components (e.g., fluid components, fluid component(s) and solid component(s)). The components may, for example, initiate a reaction. The reaction may, for example, induce dispensing of the interlock material 145.

As an illustrative example, the reaction may induce expansion of the interlock material 145. The TIM 135 may fail in response to the expansion. The interlock material 145 may expand into the firearm 105. In some embodiments, the interlock material 145 may adhere to the firearm 105. In some embodiments the interlock material 145 may physically block operation of the firearm 105. For example, in some embodiments, the interlock material 145 may include an expanding foam (e.g., polyurethane foam).

As an illustrative example, the reaction (e.g., an exothermic reaction) may increase thermal energy (e.g., heat up) of the interlock material 145. The TIM 135 may fail (e.g., melt) in response to the increased thermal energy. In some embodiments, for example, a predetermined region(s) (e.g., made of material with a predetermined glass transition temperature lower than the remainder of the wall) may fail. The failure may open an aperture 140 (e.g., a hole, separation of two or more components of the TIM 135).

In some embodiments, the reaction (e.g., an endothermic reaction) may decrease thermal energy (e.g., cool down) of the interlock material 145. At least some portion of the TIM 135 may fail (e.g., crack) in response to the decreased thermal energy and continued application of the tamper attribute(s) (e.g., another impact, continued vibration, continued pressure).

In some embodiments, an interlock material 145 may, for example, include an ignitable component. For example, an explosive may induce dispensing of the interlock material 145. In some embodiments, an explosive component may induce mixing of components of the interlock material 145. In various embodiments, an explosive component may induce a thermal reaction in the interlock material 145.

In some embodiments, the TIM 135 may be actively responsive to the tamper attribute(s). For example, a sensor(s) may generate a tamper signal(s) in response to a tamper attribute(s). An actuator(s) may be operated in response to the tamper signal(s) reaching a predetermined criterion (e.g., minimum threshold of the tamper attribute(s)). The actuator(s) may, for example, induce dispensing of the interlock material 145. For example, an actuator may induce failure of a wall (portion) of the TIM 135. An actuator may induce mixing of multiple interlock material components. An actuator may, for example, selectively open an aperture (e.g., by valve). An actuator may, by way of example and not limitation, activate a thermal module. An actuator may, for example, activate a light module.

In some embodiments, the TIM 135 may be integrally formed with the FFI 120. For example, the TIM 135 may be of unitary construction with the FFI 120. In various embodiments, the TIM 135 and/or the FFI 120 may, for example, be disposable.

In some embodiments, the TIM 135 may include a replaceable cartridge(s). For example, the TIM 135 may include a cartridge having a structure(s) (e.g., wall, satchel, chamber) responsive to at least one tamper attribute. The cartridge may include a chamber including interlock material. The cartridge may be releasably coupled to (e.g., inserted into) the FFI 120. Such embodiments may, for example, advantageously permit reuse of the FFI 120 after activation.

Figure 2:
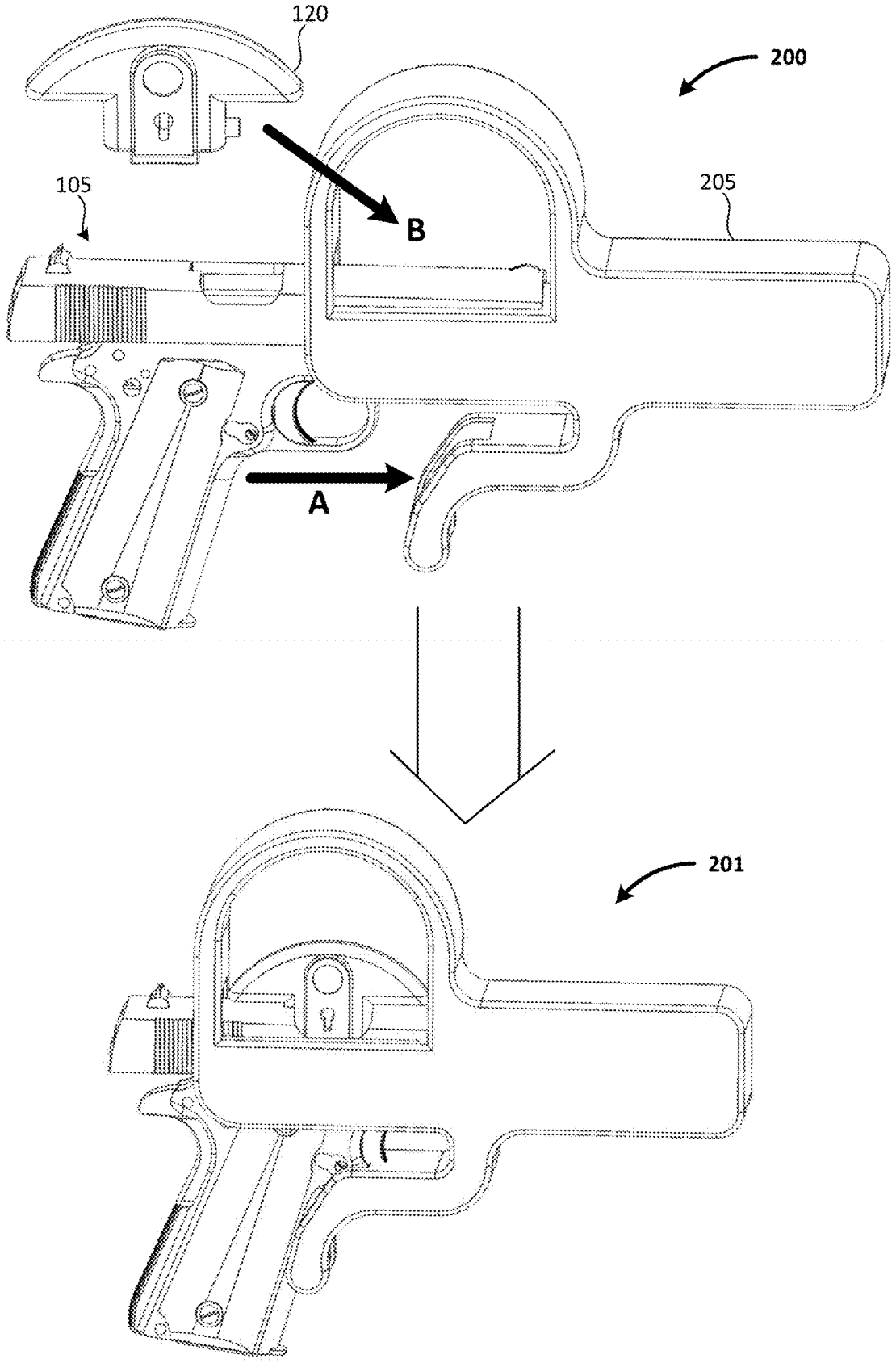
FIG. 2 the exemplary FFI of FIG. 1 and an exemplary cooperatively interlocking holster (CIH) in an illustrative use-case scenario.

FIG. 2 the exemplary FFI of FIG. 1 and an exemplary cooperatively interlocking holster (CIH) in an illustrative use-case scenario. In an unlocked mode 200, the firearm 105 is brought into register with a CIH 205. Once aligned with an opening of the CIH 205, the firearm 105 is inserted into the CIH 205 (motion "A"). The FFI 120 is then assembled to the firearm 105 (motion "B") to place the firearm 105 in a locked mode (e.g., as shown with respect to the locked mode 101). As depicted in a holstered mode 201, the FFI 120 is disposed at least partially within the CIH 205 when locked to the firearm 105. The CIH 205 prevents the firearm 105 from being withdrawn from the CIH 205. Accordingly, the firearm 105 may advantageously be locked into the CIH 205. In some embodiments, for example, the CIH 205 may advantageously protect the FFI 120 from accidental damage and/or accidental activation (e.g., dropping, bumping).

In some embodiments, the CIH 205 may be provided, for example, with an engagement member (not shown). The engagement member may engage the firearm 105 to operate the firearm 105 into a lockable mode upon insertion of the firearm 105 into the CIH 205. For example, the engagement member may engage the slide 110 (e.g., via the ejection port 115) to slide the slide 110 backwards (e.g., as shown with respect to motion "A" of FIG. 1). For example, a firearm may advantageously be automatically operated into a lockable mode when a user holsters the firearm.

In some embodiments, the FFI 120 may be coupled to the CIH 205. For example, the FFI 120 may be releasably coupled to the CIH 205. As an illustrative example, the FFI 120 may be slidably coupled to the CIH 205 such that the FFI 120 is captured by the CIH 205. The FFI 120 may, for example, be operated between a locked mode (e.g., locked mode 101) and an unlocked mode while remaining coupled to the CIH 205. For example, the CIH 205 may be provided with tracks (not shown). The FFI 120 may be provided with engagement features (not shown) configured to (releasably) engage the tracks. The engagement features may, by way of example and not limitation, include extensions on a distal end and a proximal end (relative to a longitudinal axis substantially parallel to the barrel of the firearm 105 when in the locked mode 101).

Figure 3:
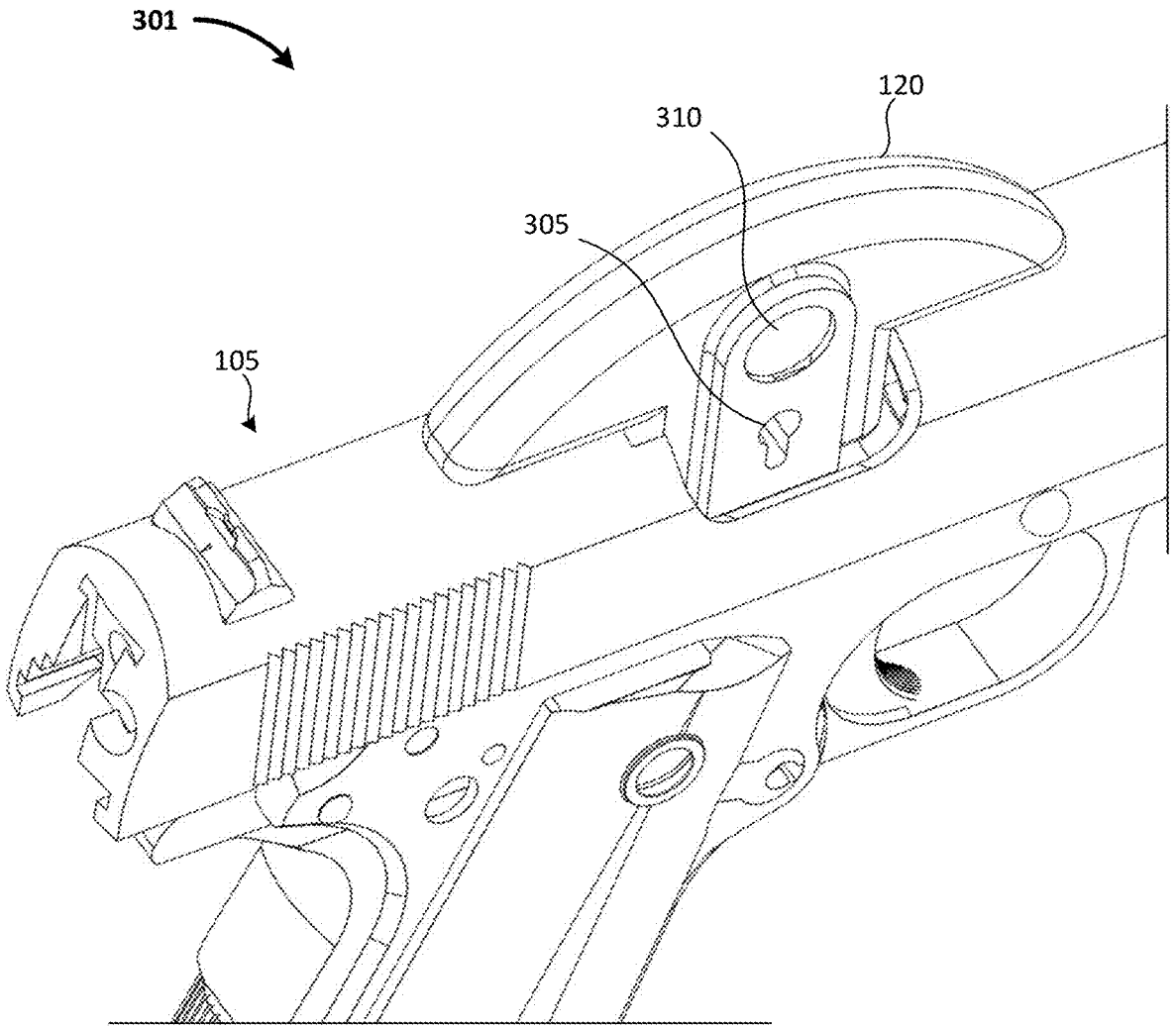
FIG. 3 depicts a close-up view of an exemplary FFI coupled to a firearm.

FIG. 3 depicts a close-up view of an exemplary FFI coupled to a firearm. A configuration 301 may, for example, correspond to the locked mode 101. In the depicted example, the engagement module of the FFI 120 includes a manual locking module 305. The manual locking module 305 may, for example, be configured to receive a key. The key may be aligned with and inserted into the manual locking module 305. The key may be operated (e.g., rotated) in the manual locking module 305 to operate the locking member 125. For example, rotation in a first direction may extend the locking member 125 into a locked mode. Rotation in a second direction (e.g., opposite to the first direction) may retrack the locking member 125 into an unlocked mode. In the locked mode, the FFI 120 may resist removal from the firearm 105. In the unlocked mode, the FFI 120 may, for example, be readily removed from the firearm 105.

In the depicted example, the FFI 120 includes a biometric locking module 310. The biometric locking module 310 may, for example, include a biometric attribute sensor(s). As an illustrative example, the biometric attribute sensor(s) may include a fingerprint reader. As depicted, the biometric locking module 310 may be configured such that an authorized user may grip the FFI 120 (e.g., in a 'pinching' motion) such that a predetermined digit (e.g., thumb, finger) is presented to the biometric locking module 310. The biometric locking module 310 may compare an input signal corresponding to the presented digit to a predetermined biometric profile(s) (e.g., stored locally, stored and/or compared via a remote computing device). In response to determining that the input signal corresponds to an authorized user, the biometric locking module 310 may generate an unlock signal. The biometric locking module 310 may be operably coupled to the locking member 125 such that the locking member 125 is operated into an unlocked mode (e.g., retracted) in response to the unlock signal generated by the biometric locking module 310. Accordingly, in some embodiments, a user may advantageously gain access quickly without operating a key.

In some embodiments, the biometric locking module 310 may generate a signal based on a current state of the FFI 120 and the input signal(s). For example, an authorized user may operate the FFI 120 via the biometric locking module 310 to lock and/or unlock the FFI 120. The FFI 120 may determine whether a lock signal or unlock signal should be generated based on a current state of the FFI 120. For example, in the unlocked mode, upon presentation of an authorized biometric attribute, the biometric locking module 310 may generate a lock signal. In the locked mode, upon presentation of an authorized biometric attribute, the biometric locking module 310 may generate the unlock signal.

In some embodiments, the FFI 120 may be responsive to (predetermined) input(s) from any user when in the unlocked mode. For example, the FFI 120 may respond to input in the biometric locking module 310 from any human digit when in the unlocked mode. As an illustrative example, the FFI 120 may, when in the unlocked mode and in response to detecting a human digit input via the biometric locking module 310, operate the locking member 125 into a locked mode. Such embodiments may, for example, advantageously enable any person to rapidly lock a firearm 105. For example, a bystander may see an unlocked firearm with a child present and lock the firearm without having to be an unauthorized user. In some embodiments, the FFI 120 may only respond to any user when in a predetermined geographic zone. Such embodiments may, for example, advantageously allow a firearm to be quickly locked at home (e.g., by any member of the family), but may advantageously prevent a miscreant from disabling the firearm in public in a dangerous situation.

Figure 4A:
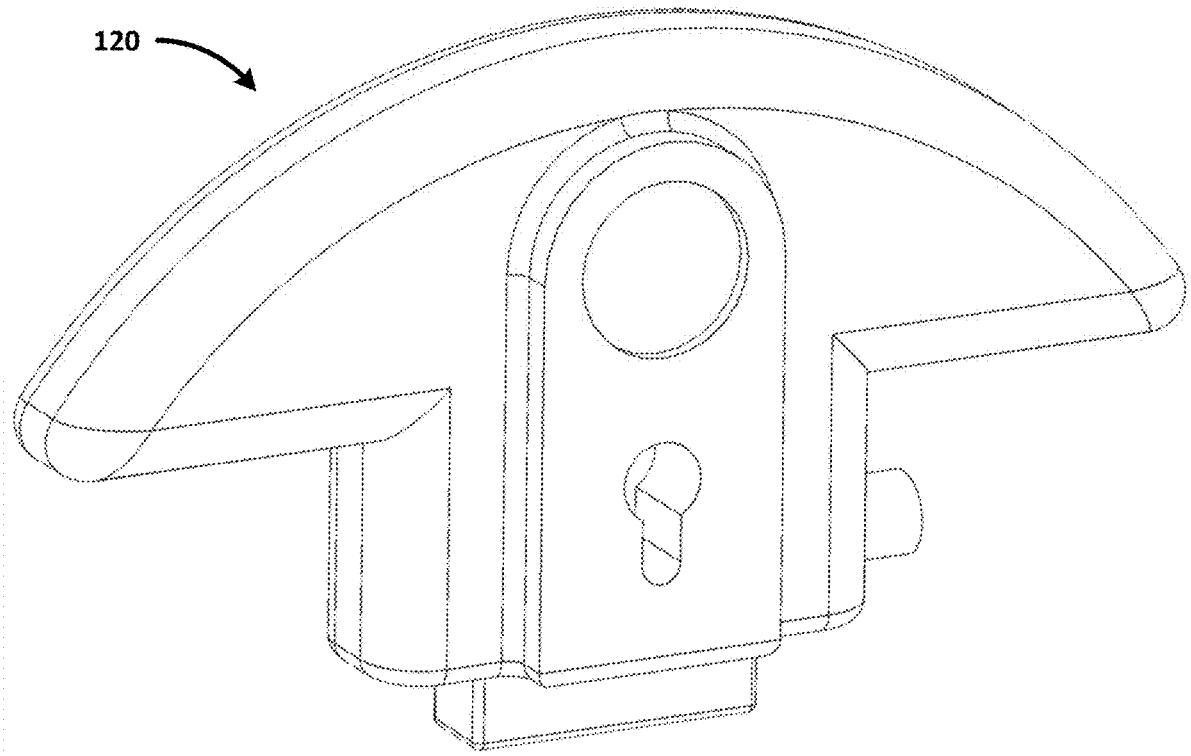
FIG. 4A and FIG. 4B depict front and rear perspective views, respectively, of an exemplary FFI.
Figure 4B:
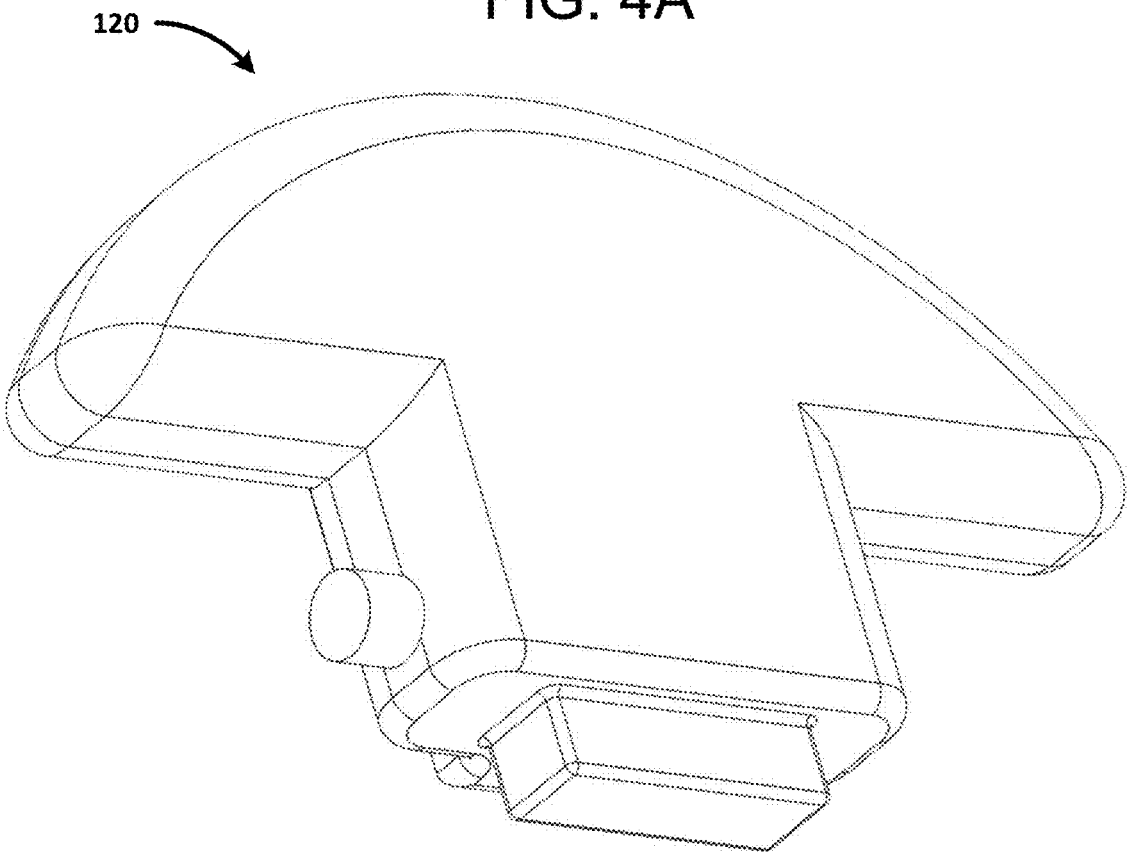
Figure 4C:
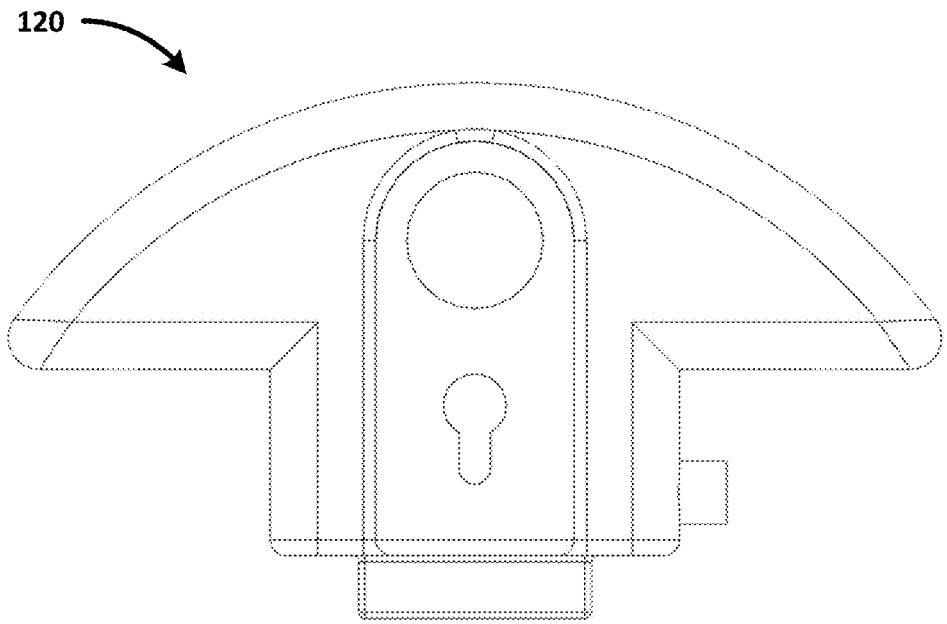
FIG. 4C and FIG. 4D depict front and rear elevation views, respectively, of the exemplary FFI of FIG. 4A.
Figure 4D:
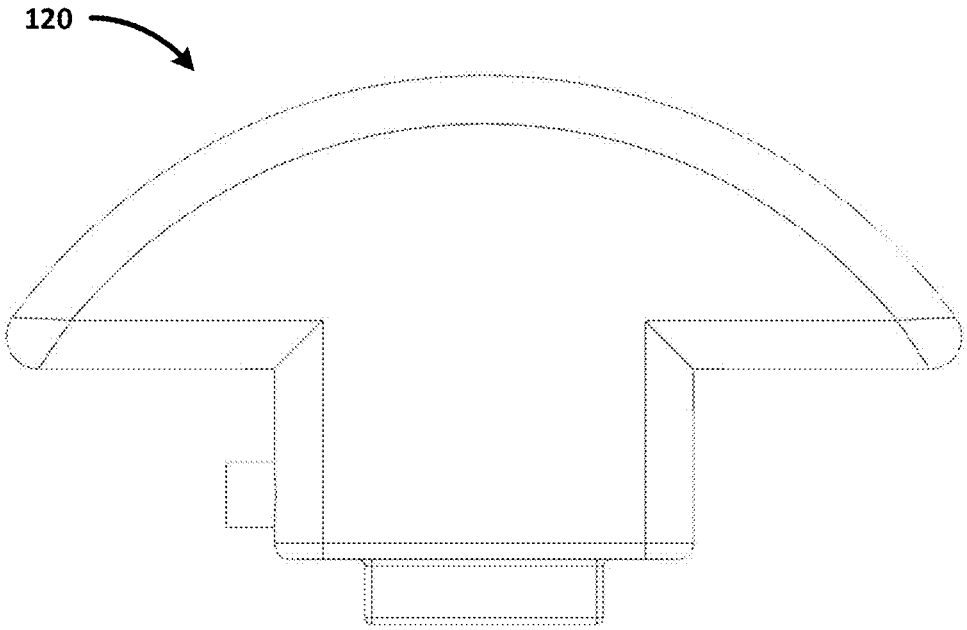
Figure 4E:
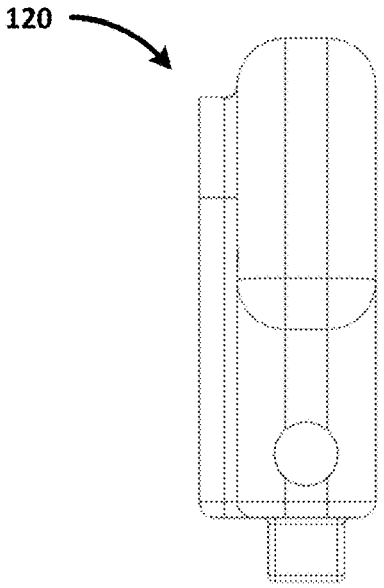
FIG. 4E and FIG. 4F depict right and left elevation views, respectively, of the exemplary FFI of FIG. 4A.
Figure 4F:
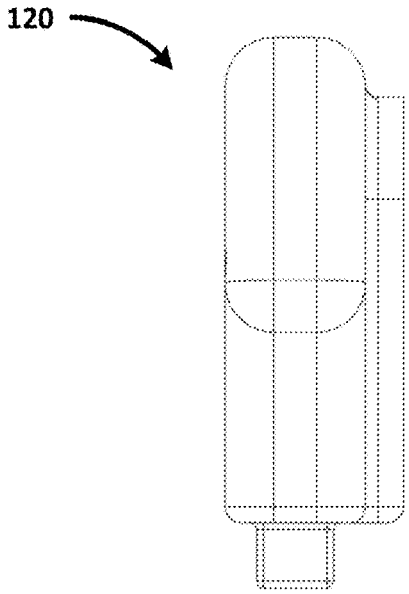
Figure 4G:
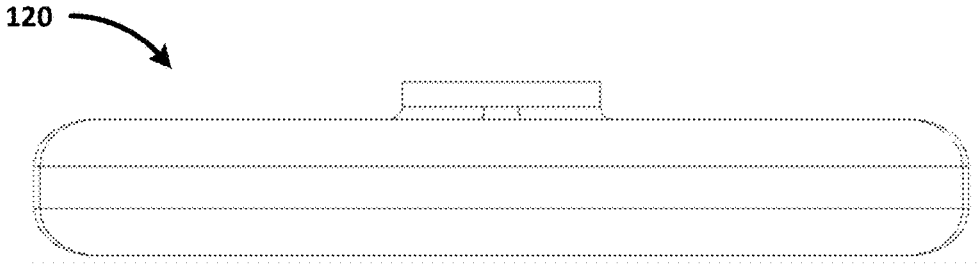
FIG. 4G and FIG. 4H depict top and bottom plan views, respectively, of the exemplary FFI of FIG. 4A.
Figure 4H:
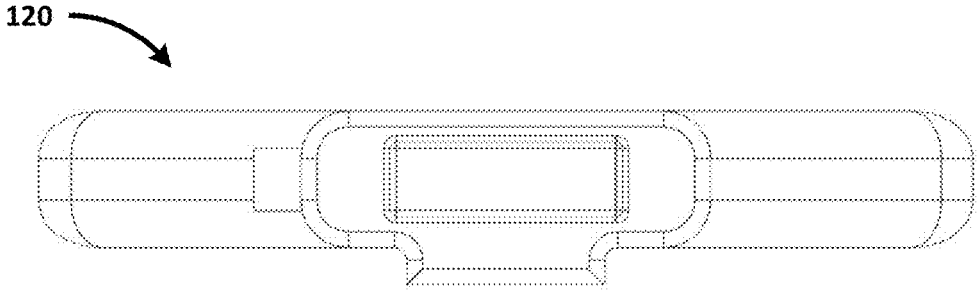

FIG. 4A and FIG. 4B depict front and rear perspective views, respectively, of an exemplary FFI. FIG. 4C and FIG. 4D depict front and rear elevation views, respectively, of the exemplary FFI of FIG. 4A. FIG. 4E and FIG. 4F depict right and left elevation views, respectively, of the exemplary FFI of FIG. 4A. FIG. 4G and FIG. 4H depict top and bottom plan views, respectively, of the exemplary FFI of FIG. 4A.

Figure 5A:
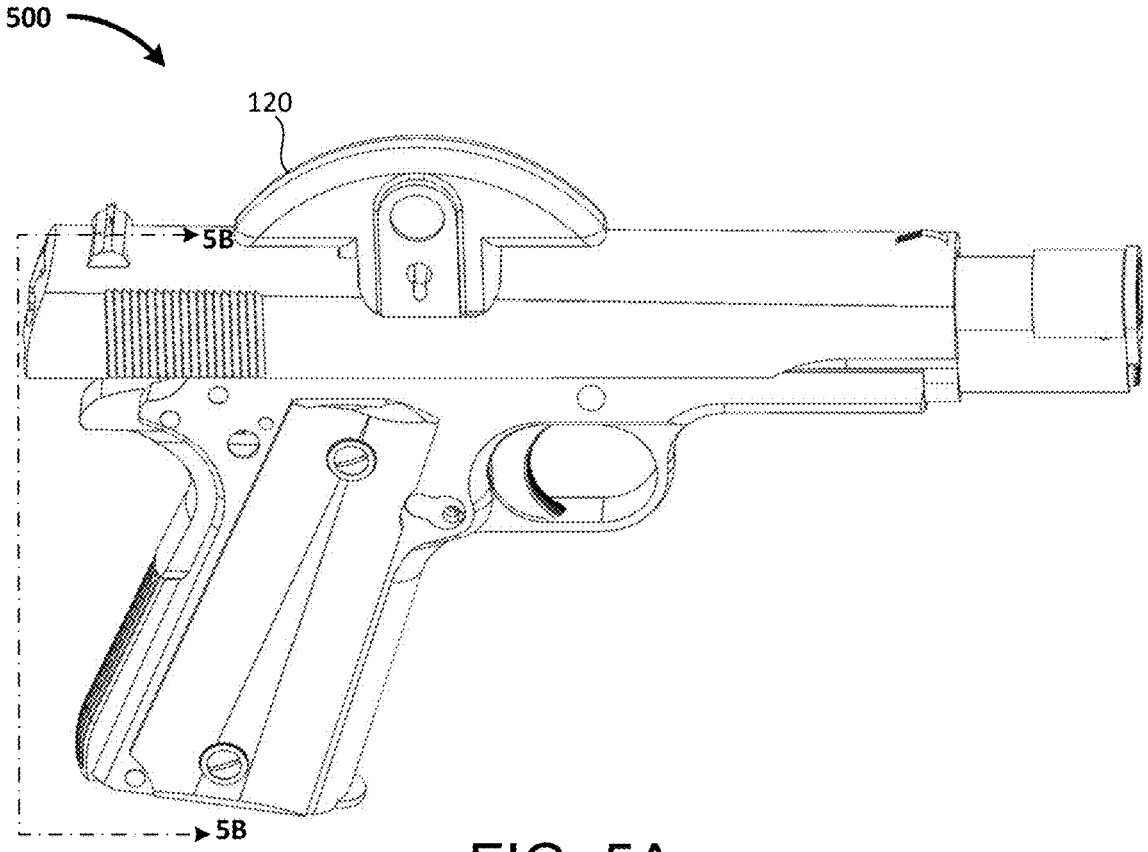
FIG. 5A depicts an exemplary FFI in a deployed mode an illustrative use-case scenario.

FIG. 5A depicts an exemplary FFI in a deployed mode an illustrative use-case scenario.

Figure 5B:
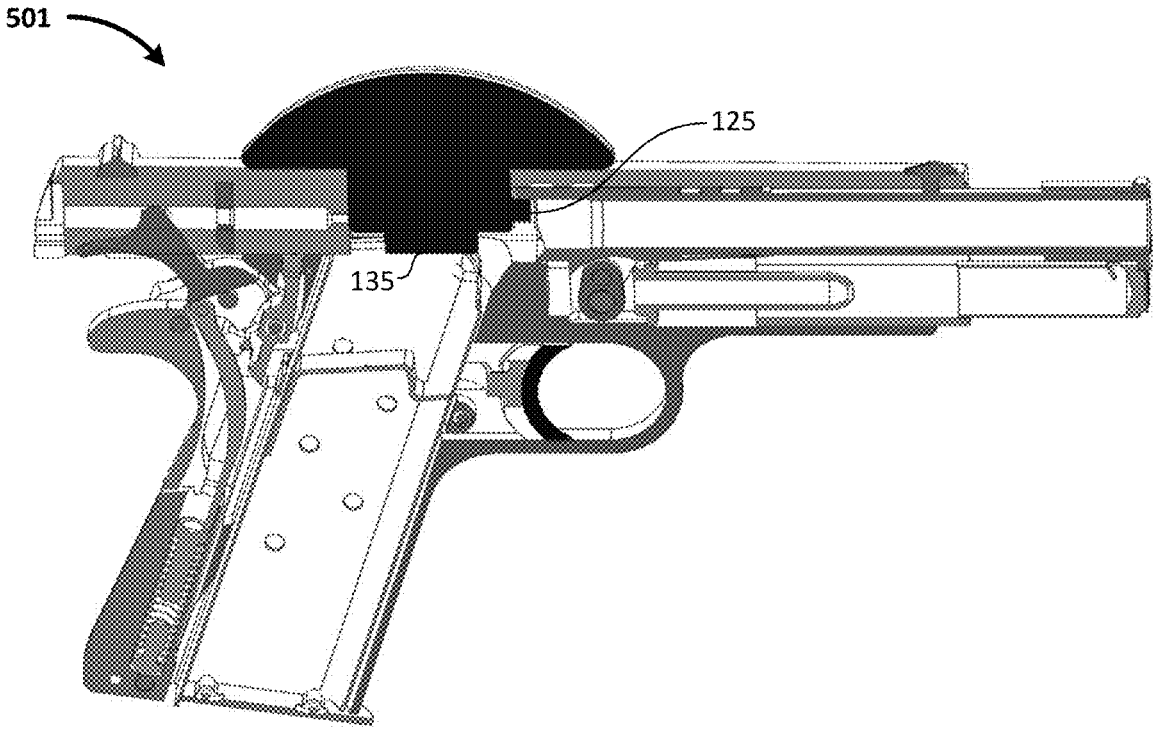
FIG. 5B depicts a cross-section view of the exemplary FFI of FIG. 5A.
Figure 6:
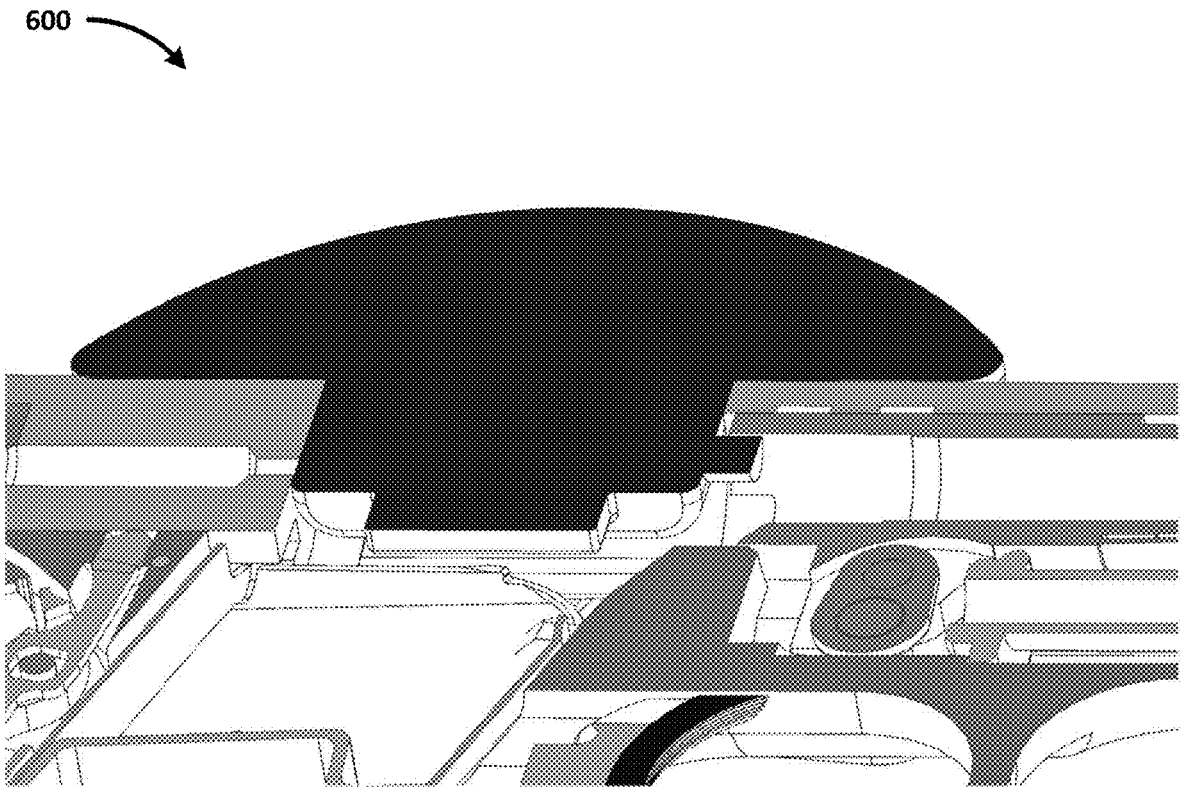
FIG. 6 depicts a close-up cross-section view of the exemplary FFI of FIG. 5A.

FIG. 5B depicts a cross-section view of the exemplary FFI of FIG. 5A. FIG. 6 depicts a close-up cross-section view of the exemplary FFI of FIG. 5A. The firearm 105 and the FFI 120 are shown in a first view 500 (e.g., corresponding to the locked mode 101). A second view 501 depicts a cross-section view of the firearm 105 and the FFI 120. The TIM 135 is disposed in the firearm 105. The locking member 125 is operated into the locked mode such that the locking member 125 protrudes into the barrel of the firearm 105 along a longitudinal axis along which the barrel extends. A third view 600 depicts a close-up cross-section view of the FFI 120 in the firearm 105 in a locked mode. Internal components of the FFI 120 are not shown.

Figure 7:
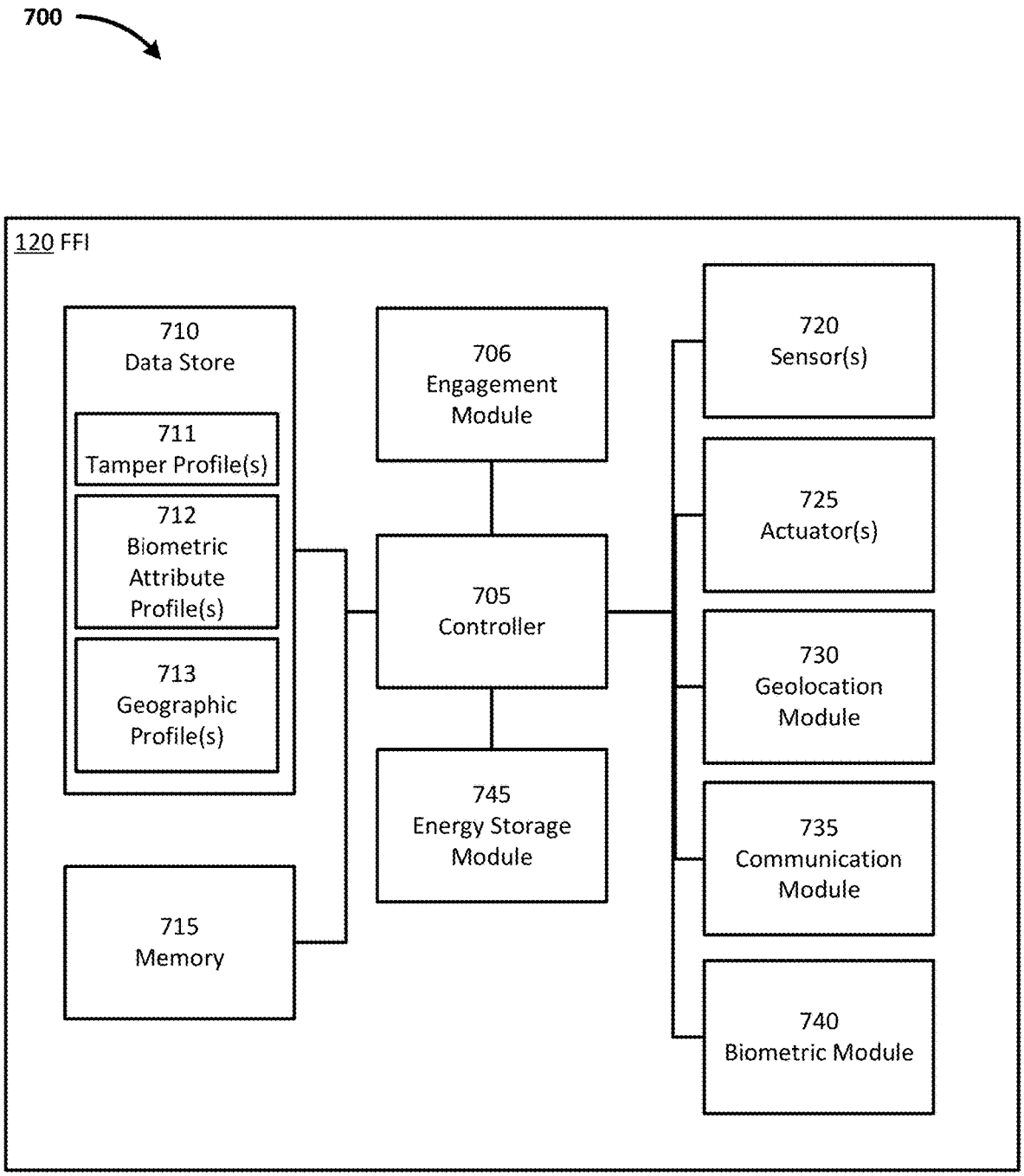
FIG. 7 depicts a block diagram of an exemplary FFI.

FIG. 7 depicts a block diagram of an exemplary FFI. An exemplary system 700 includes a FFI 120. As depicted, the FFI 120 includes a controller 705. The controller 705 may, for example, include one or more processors. In some embodiments the controller 705 may include one or more application-specific integrated circuits (ASICs). In some embodiments the controller 705 may, for example, include one or more field-programmable gate arrays (FPGAs).

The controller 705 is operably coupled to an engagement module 706. The engagement module 706 may, for example, include the locking member 125. The controller 705 may operate the engagement module 706, for example, via one or more actuators. The controller 705 may operate the engagement module 706, for example, in response to one or more input signal(s) (e.g., from a communication module, from a sensor).

The controller 705 is operably coupled to a data store 710 and a memory module 715. The data store 710 may, for example, include one or more non-volatile memory modules. The memory module 715 may, for example, include one or more random-access memory modules. In the depicted example, the data store 710 includes one or more tamper profiles 711. The data store 710 includes one or more biometric attribute profiles 712. The data store 710 includes one or more geographic profiles 713.

The controller 705 is operably coupled to one or more sensors 720. The one or more sensors 720 may, for example, include tamper sensors. For example, tamper sensors may include force sensors. Tamper sensors may, for example, include pressure sensors. In some embodiments, tamper sensors may include vibration sensors. Tamper sensors may include, by way of example and not limitation, strain sensors. In various embodiments, tamper sensors may include contact and/or proximity sensors.

The one or more sensors 720 may include, for example, environmental sensors. For example, in some embodiments environmental sensors may include at least one optical sensor. An optical sensor may, for example, include a camera. In some embodiments, environmental sensors may include, by way of example and not limitation, audio sensors. For example, an audio sensor may include a microphone. The controller 705 may, for example, selectively operate the environmental sensor(s) and/or other sensors in response to input(s) (e.g., from a remote source, from the one or more sensors 720) based on a predetermined response profile(s).

The controller 705 is operably coupled to one or more actuators 725. The one or more actuators 725 may include, for example, a lock actuator. The lock actuator may, for example, be configured to selectively extend and/or retract the locking member 125, for example. In some embodiments the lock actuator may include a linear actuator. In some embodiments the lock actuator may include a rotary actuator. The locking member 125 may, for example, in some embodiments, be configured as a rotating member (e.g., a cam and/or hook).

The controller 705 is operably coupled to a geolocation module 730. The geolocation module 730 may include, for example, a circuit(s) configured to detect current geo-spatial coordinates of the FFI 120. For example, the geolocation module 730 may communicate with one or more geolocation satellites (e.g., GPS, GLONASS, BeiDou). The controller 705 may, for example, generate one or more signals in response to a current geo-spatial coordinates of the FFI 120. The controller 705 may compare the current geo-spatial coordinates to the one or more geographic profiles 713. As an illustrative example, the controller 705 may operate the engagement module 706 into a locked mode in response to determining based on a geolocation signal(s) from the geolocation module 730 that the FFI 120 has entered a restricted zone (e.g., school zone) as defined by the one or more geographic profiles 713. In some embodiments the one or more geographic profiles 713 may be dynamically updated. In some embodiments the controller 705 may respond to outside zones (e.g., 'no-gun' signals from a remote emitter).

The controller 705 is operably coupled to a communication module 735. The communication module 735 may provide communication between the controller 705 and external devices (e.g., charging, communication). The communication module 735 may include wired communication (e.g., USB port(s), RJ45 port(s), charging port(s), audio port(s), video port(s)). The communication module 735 may include wireless communication (e.g., Wi-Fi, Bluetooth). For example, the data store 710 (e.g., including profile(s) stored therein) may be dynamically updated based on signals received from the communication module 735. In some embodiments, for example, one or more profiles may be dynamically retrieved from, generated by, transmitted to, and/or processed using a remote computing device via the communication module 735.

The controller 705 is operably coupled to a biometric module 740. In some embodiments, for example, the biometric module 740 may include the biometric locking module 310. The biometric module 740 may, for example, be connected to a biometric attribute sensor(s) (e.g., of the one or more sensors 720). Biometric attribute sensor(s) may, for example, include a fingerprint scanner. A biometric attribute sensor may include a camera (e.g., configured as a face scanner). A biometric attribute sensors may, for example, include a retinal scanner. In some embodiments a biometric attribute reader may include an audio sensor. The controller 705 may operate one or more actuators 725 corresponding to the engagement module 706 in response to the biometric module 740.

Figure 8A:
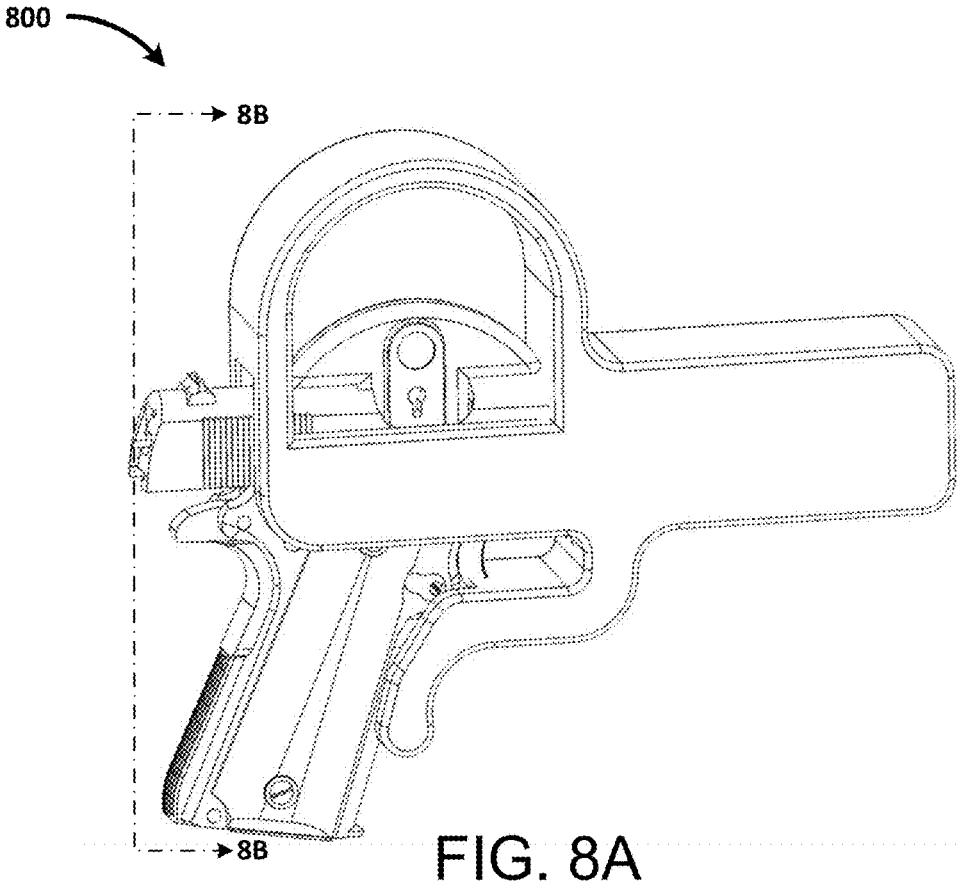
FIG. 8A depicts an exemplary FFI and CIH in an illustrative use-case scenario.
Figure 8B:
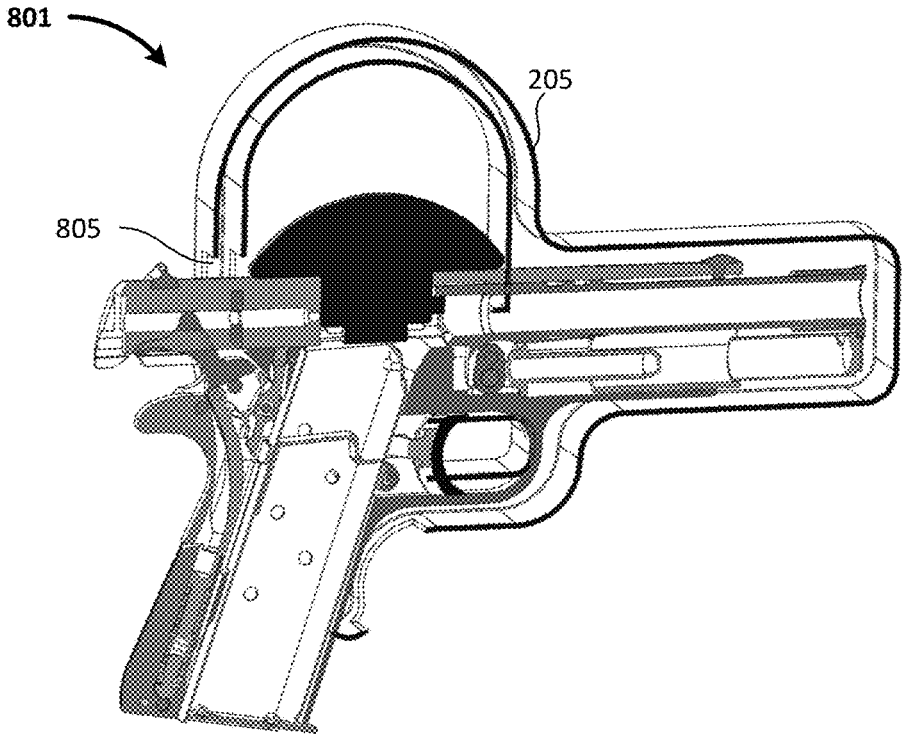
FIG. 8B depicts a cross-section view of the exemplary FFI and CIH of FIG. 8A.

The controller 705 is operably coupled to an energy storage module 745. The energy storage module 745 may, for example, include a battery. The energy storage module 745 may, for example, receive power from a charging input (not shown), such as via the communication module 735. In some embodiments the energy storage module 745 may include multiple batteries. In some embodiments the energy storage module 745 may include disposable batteries. The energy storage module 745 may, for example, provide power to the controller 705, the engagement module 706, the data store 710, the memory module 715, the one or more sensors 720, the one or more actuators 725, the geolocation module 730, the communication module 735, the biometric module 740, or some combination thereof FIG. 8A depicts an exemplary FFI and CIH in an illustrative use-case scenario. FIG. 8B depicts a cross-section view of the exemplary FFI and CIH of FIG. 8A. The CIH 205 includes an insertion aperture 805. As depicted, the insertion aperture 805 is sized and shaped to allow insertion and/or withdrawal of the firearm 105 when the firearm 105 is disassembled from the FFI 120 (as shown in an unholstered mode 800). Assembly of the FFI 120 to the firearm 105 once the firearm 105 is inserted into the CIH 205 through the insertion aperture 805 (as shown in a holstered mode 801) prevents withdrawal of the firearm 105 from the CIH 205 through the insertion aperture 805. Accordingly, various embodiments may advantageously lock the firearm 105 into the CIH 205.

Figure 9A:
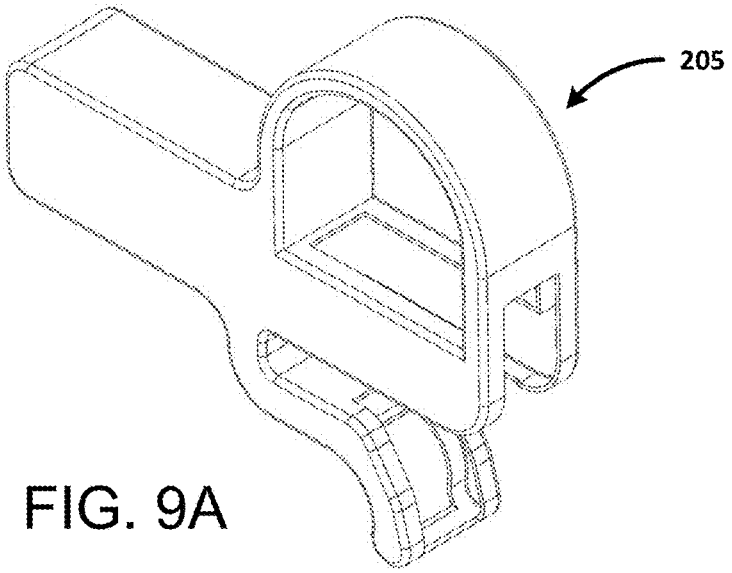
FIG. 9A depicts a perspective view of an exemplary CIH.
Figure 9B:
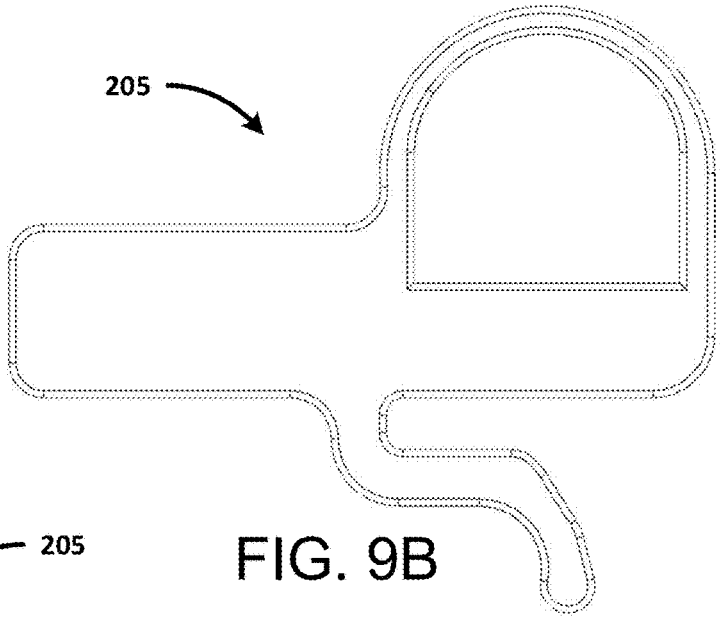
FIG. 9B and FIG. 9C depict front and rear elevation views of the exemplary CHI of FIG. 9A.
Figure 9C:
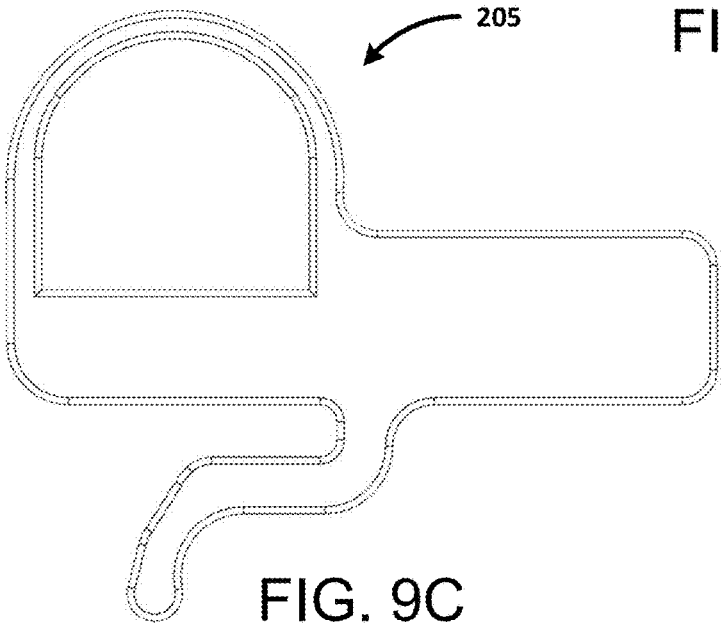
Figure 9D:
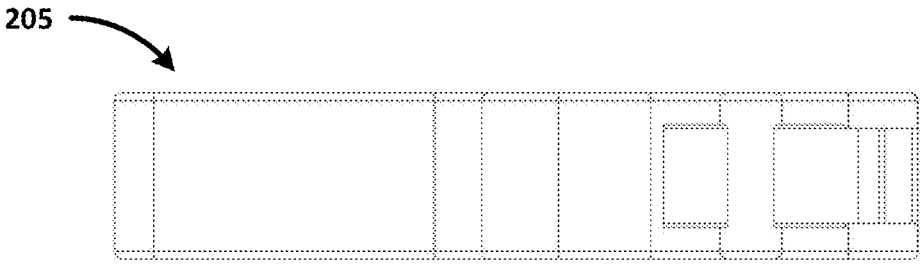
FIG. 9D and FIG. 9E depict top and bottom plan views of the exemplary CHI of FIG. 9A.
Figure 9E:
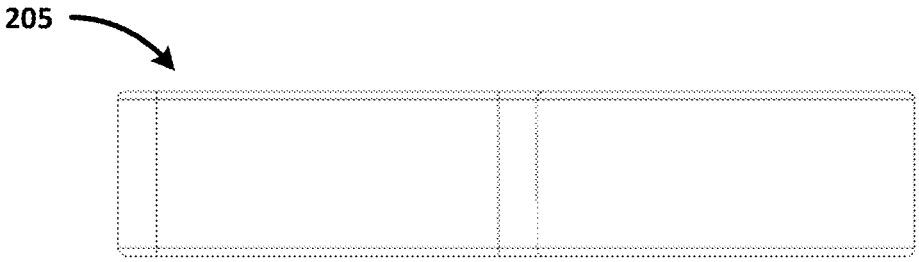
Figure 9F:
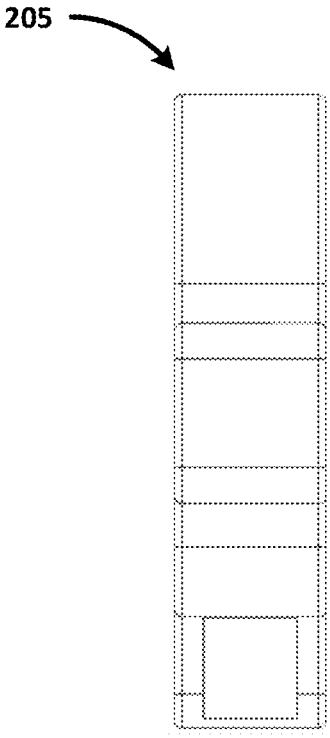
FIG. 9F and FIG. 9G depict left and right elevation views of the exemplary CHI of FIG. 9A.
Figure 9G:
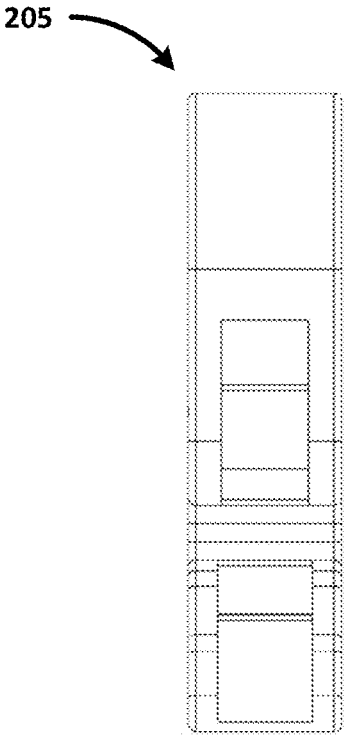

FIG. 9A depicts a perspective view of an exemplary CIH. FIG. 9B and FIG. 9C depict front and rear elevation views of the exemplary CHI of FIG. 9A. FIG. 9D and FIG. 9E depict top and bottom plan views of the exemplary CHI of FIG. 9A. FIG. 9F and FIG. 9G depict left and right elevation views of the exemplary CHI of FIG. 9A.

Figure 10:
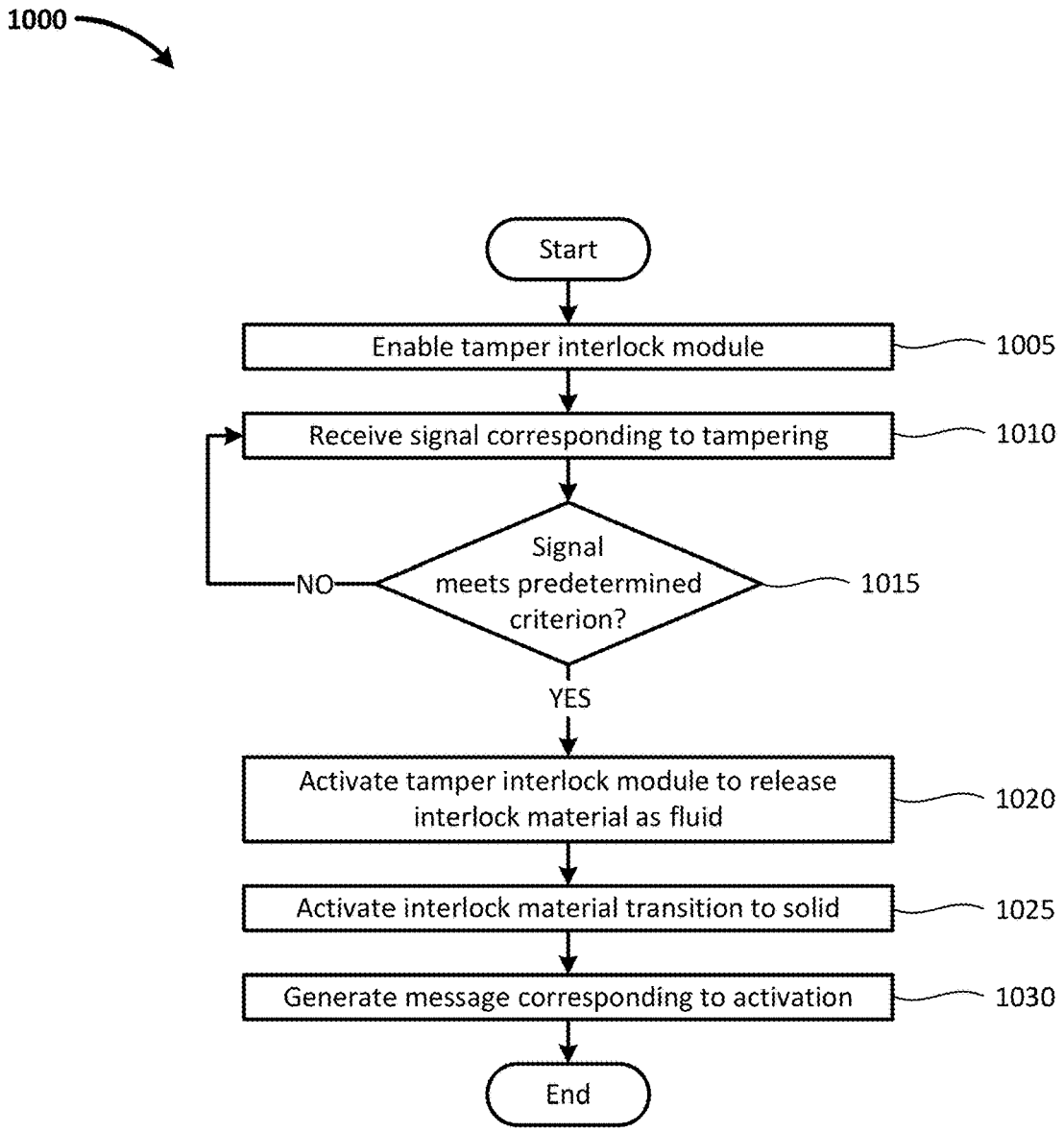
FIG. 10 depicts an exemplary method of activation of a tamper interlock module of an exemplary FFI.

FIG. 10 depicts an exemplary method of activation of a tamper interlock module of an exemplary FFI. In some embodiments, a method 1000 may be performed at least partially be a controller executing a program of instructions such as, for example, the controller 705 as disclosed at least with reference to FIG. 7. As depicted, the method 1000 includes a step 1005 of enabling a tamper interlock module (TIM, such as, for example, the TIM 135). The step 1005 may, for example, be performed by a processor. As an illustrative example, the TIM may be operated into an enabled mode (e.g., responsive to input signals associated with tampering) in response to an input. The input may, for example, include user activation (e.g., operating an ON/OFF switch). The input may, for example, include geospatial activation. For example, the TIM may be enabled in response to receiving a signal(s) corresponding to the FFI being removed from a region corresponding to a locked cabinet. The TIM may be enabled, for example, in response to receiving a signal(s) corresponding to the FFI entering a predetermined zone.

In a step 1010, a signal(s) is received corresponding to tampering. The signal may, for example, be received from a sensor(s) (e.g., as disclosed at least with reference to the one or more sensors 720 with reference to FIG. 7). In some embodiments, the signal may include a (passive) mechanical signal. In some embodiments, for example, the tamper signal may be generated in response to a mechanical input such as depicted being applied by the destructive device 130 with reference to FIG. 1.

In a decision point 1015, if the signal is determined to not meet a predetermined criterion, then the method 1000 returns to the step 1010. In some embodiments, for example, the signal(s) may be compared to a tamper profile (e.g., the one or more tamper profiles 711). In some embodiments, the signal(s) may be passively compared (e.g., by a mechanical failure region of the TIM). Once the signal(s) received in the step 1010 meet the predetermined criterion in the decision point 1015, then the TIM is activated in a step 1020.

Upon activation of the TIM, interlock material is released in the step 1020, in a fluid form. The fluid form may, by way of example and not limitation, include particulate form. In some embodiments the fluid form may include a gaseous form. In some embodiments, the fluid form may include a liquid phase material.

The interlock material is activated in a step 1025 such that the interlock material (begins) transition to a solid. The transition may, for example, include a thermodynamic phase change transition (e.g., from liquid to solid). In some embodiments the transition may, for example, include an aggregation and/or cross-linking of components (e.g., particles, molecules) to form an obstructive and/or adhesive (semi-)solid.

A message corresponding to activation is generated, in a step 1030. The message may, for example, include data relating to the tamper profile and/or the tamper signal(s) received in the step 1010. In some embodiments the message may include, for example, a date and/or time. Some embodiments may include location data (e.g., geo-spatial coordinates). The message may, for example, be transmitted to a (predetermined) user(s) and/or emergency personnel (e.g., law enforcement). In some embodiments the message may include optical (e.g., video, images) and/or audio data corresponding to the tamper signal. In some embodiments the step 1030 may, for example, be omitted.

Figure 11:
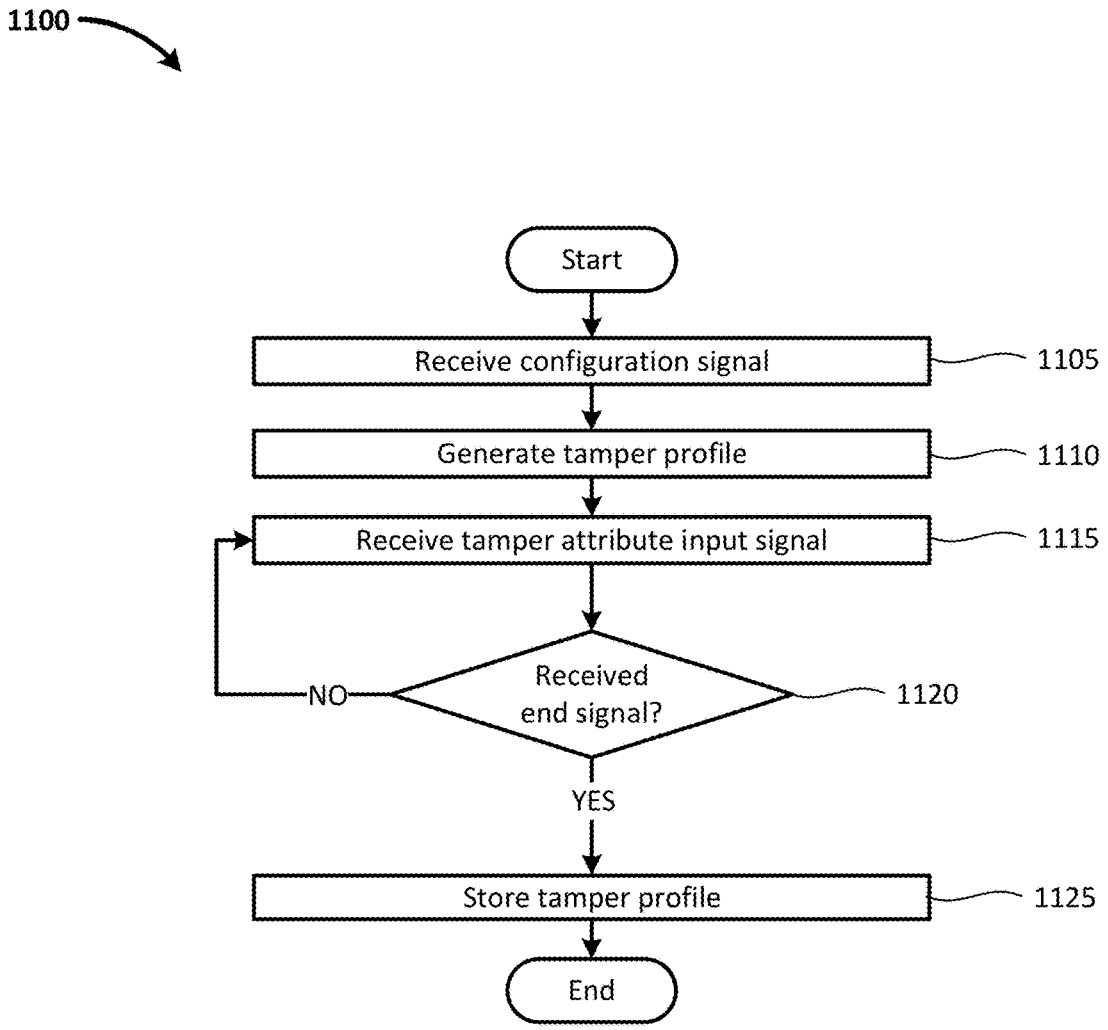
FIG. 11 depicts an exemplary method of configuration of an exemplary FFI.

FIG. 11 depicts an exemplary method of configuration of an exemplary FFI. In some embodiments, a method 1100 may be performed at least partially be a controller executing a program of instructions such as, for example, the controller 705 as disclosed at least with reference to FIG. 7. As depicted, the method 1100 includes a step 1105 of receiving a configuration signal. The configuration signal may, for example, be generated in response to user input entering a teaching mode. In some embodiments the configuration signal may, for example, be generated in response to receiving a configuration profile (e.g., tamper profile, biometric attributes profile, geographic profile). In some embodiments the configuration signal may be generated in response to a user operating an input to initiate a configuration mode to generate one or more profile(s).

In a step 1110, a tamper profile is generated. In some embodiments another type of profile may, for example, be generated (e.g., biometric attributes profile, geographic profile). A tamper attribute input signal(s) is received in a step 1115 and the tamper profile is updated. In some embodiments, the tamper attribute signal may be another type of signal (e.g., biometric attribute signal, geographic signal).

Once it is determined in a decision point 1120 that an end signal has been received (e.g., a positive signal indicating completion of configuration, an absence of further signals received for a predetermined period of time), then the tamper profile is stored (e.g., to the data store 710) in a step 1125.

Although various embodiments have been described with reference to the figures, other embodiments are possible. For example, various embodiments may be configured for different sizes of guns. In some embodiments, an FFI may be sized for a specific caliber. In some embodiments an FFI may be sized for a specific range of calibers. For example, various embodiments may be configured such that thousands of different firearms (e.g., rifles, shotguns, handguns) may advantageously be protected using only a few different locks. For example, five to six different FFI configurations (e.g., having different sizes of a portion that inserts into the ejection port and/or different sizes and/or shapes of the locking member 125) may advantageously be operable to protect thousands of different firearms. Such embodiments may advantageously reduce manufacturing (e.g., tooling) and/or inventory costs. Accordingly, various such embodiments may advantageously reduce cost and/or difficulty (e.g., locating and/or maintaining many different sizes/configurations of locks) to consumers to protect their firearms.

In some embodiments, an FFI may be adjustable to engage multiple sizes of firearms. For example, a locking member (e.g., the locking member 125) may be adjustable in length and/or diameter. In some embodiments the locking member may have a polygonal cross-section relative to the longitudinal axis of the firearm barrel. The locking member may have multiple components that may be adjusted in width and/or height to control a cross-sectional area. The locking member may, for example, be telescopic.

In some embodiments an electronically operated lock (e.g., the biometric locking module 310) may operate in cooperation with a manual lock (e.g., the manual locking module 305). For example, the manual lock may override the electronically operated lock. Such embodiments may, for example, advantageously provide a safety override while maintaining ease and/or speed of access of an electronically operated (e.g., biometric) lock.

In some embodiments a portion(s) of the FFI inserted into the firearm may be adjustable. For example, a width, depth, and/or thickness of the FFI may be adjustable.

In some embodiments an interlock material transition may form a 'gel-like' material having a viscosity above a predetermined minimum threshold. For example, the viscosity may be selected to allow the material to remain between moving parts with tight clearances (e.g., firing pin, hammer, slide). The viscosity may be selected to increase friction between the moving parts with tight clearances such that response time is slowed down to disable normal operation of the parts and/or associated assemblies. For example, the gel may prevent the firing pin from striking a cartridge with sufficient force to activate (e.g., ignite) an explosive (e.g., gunpowder). The gel may, for example, prevent the slide from cycling with sufficient force to load a cartridge from the magazine.

In some embodiments the interlock material may be washable (e.g., dissolvable by a predetermined solvent(s)). In some embodiments the solvent may include water. The interlock material may be configured such that the dissolution takes a minimum predetermined time (e.g., greater than 10 minutes, greater than 30 minutes, greater than 1 day). Accordingly, the interlock material may be advantageously removed but may prevent unauthorized access for a minimum amount of time.

In some embodiments, an FFI may be configured for a specific handed user (e.g., left-handed, right-handed). For example, a user interface of an engagement module may be oriented such that, when a locking member is engaged in a firearm, the user interface (e.g., key opening, biometric input) is positioned advantageously for rapid engagement by the user. In some embodiments an FFI may be user-configurable between handedness. For example, a locking member and/or user interface may be operated onto a preferred side and/or into a preferred orientation (e.g., upwards, rearwards, sideways). In some embodiments, a user interface may be accessible from multiple sides (e.g., apertures into a lock from both sides, multiple biometric input sensor(s) input surfaces). Such embodiments may, for example, advantageously be 'universal' for multiple handed users (e.g., members of a same family). Such embodiments may, for example, reduce manufacturing and/or inventory cost, and so may advantageously reduce cost of ownership for a user.

Although an exemplary system has been described with reference to the figures, other implementations may be deployed in other industrial, scientific, medical, commercial, and/or residential applications.

In various embodiments, some bypass circuits implementations may be controlled in response to signals from analog or digital components, which may be discrete, integrated, or a combination of each. Some embodiments may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Although an example of a system, which may be portable, has been described with reference to the above figures, other implementations may be deployed in other processing applications, such as desktop and networked environments.

Temporary auxiliary energy inputs may be received, for example, from chargeable or single use batteries, which may enable use in portable or remote applications. Some embodiments may operate with other DC voltage sources, such as a 9V (nominal) battery, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital circuitry, analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Various embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random-access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various embodiments may be implemented in a computer system that includes a graphical user interface and/or an Internet browser. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, the computers and networks forming the Internet, or some combination thereof. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

In an illustrative aspect, a firearm lock may include an engagement module configured to be brought into register with and be inserted at least partially into a firing chamber of a firearm such that, in a locked mode, the engagement module is releasably coupled to the firearm and prevents a firing mechanism of the firearm from activating a projectile. The firearm lock may include a tamper interlock module including a wall defining a cavity, the cavity containing interlock material in a fluid state, wherein the wall is configured such that, when a predetermined force is applied to the wall, the interlock material is dispensed from the cavity into the firing chamber and the interlock material at least partially transitions into a solid state such that the interlock material prevents the firing mechanism from activating the projectile. The firearm lock may include a biometric module operably coupled to the engagement module such that, in response to receiving a signal corresponding to at least one predetermined physiological attribute, the biometric module operates the engagement module from the locked mode to an unlocked mode.

The firearm lock may include a geolocation module operably coupled to the tamper interlock module such that, in response to a signal corresponding the firearm entering a predetermined geographical region, the interlock material is dispensed from the cavity into the firing chamber.

The wall may include plastic. The interlock material may be dispensed in response to material failure of the wall. The wall may include a region of predetermined stress concentration. The interlock material may be dispensed in response to material failure of the wall.

The interlock material may include a resin. The interlock material may include a hardener. The interlock material may at least partially transition into the solid state in response to the hardener and the resin being combined.

The firearm lock may include a holster. The holster may include a holster wall defining an aperture into a holster cavity. The aperture may be configured such that when the firearm is inserted into the holster cavity through the aperture, and the engagement module is inserted into the firing chamber and operated into the locked mode, the engagement module resists removal of the firearm from the holster.

In an illustrative aspect, a firearm lock may include an engagement module configured to be brought into register with and be inserted at least partially into a firing chamber of a firearm such that, in a locked mode, the engagement module is releasably coupled to the firearm and prevents a firing mechanism of the firearm from activating a projectile. The firearm lock may include a tamper interlock module having a wall defining a cavity, the cavity containing interlock material in a fluid state, wherein the wall is configured such that, when a predetermined force is applied to the wall, the interlock material is dispensed from the cavity into the firing chamber and the interlock material at least partially transitions into a solid state such that the interlock material prevents the firing mechanism from activating the projectile.

The firearm lock may include a biometric module operably coupled to the engagement module such that, in response to receiving a signal corresponding to at least one predetermined physiological attribute, the biometric module operates the engagement module from the locked mode to an unlocked mode.

The engagement module may include a locking member operable to slidably extend such that, when the engagement module is brought into register with and inserted into the firing chamber and operated into the locked mode, the locking member extends into a barrel of the firearm such that the locking member resists removal of the engagement module from the firearm. The locking member may be operable to slidably extend in response to insertion and rotation of a key in a lock module of the engagement module.

The firearm lock may include a geolocation module operably coupled to the tamper interlock module such that, in response to a signal corresponding the firearm entering a predetermined geographical region, the interlock material is dispensed from the cavity into the firing chamber. The geolocation module may further be operably coupled to the engagement module such that, in response to a signal corresponding the firearm entering a predetermined geographical region, the interlock material is dispensed from the cavity into the firing chamber only if the engagement module is in a locked mode.

The firearm lock may include a geolocation module operably coupled to the tamper interlock module such that, in response to a signal corresponding the firearm entering a predetermined geographical region, the tamper interlock module is operated into an enabled mode.

The wall may include plastic. The interlock material may be dispensed in response to material failure of the wall. The wall may include a region of predetermined stress concentration. The interlock material may be dispensed in response to material failure of the wall.

The interlock material may include a resin. The interlock material may further include a hardener. The interlock material may least partially transition into the solid state in response to the hardener and the resin being combined.

The firearm lock may include a holster. The holster may include a holster wall defining an aperture into a holster cavity. The aperture may be configured such that when the firearm is inserted into the holster cavity through the aperture, and the engagement module is inserted into the firing chamber and operated into the locked mode, the engagement module resists removal of the firearm from the holster.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A firearm lock, comprising:

an engagement module configured to be brought into register with and be inserted at least partially into a firing chamber of a firearm such that, in a locked mode, the engagement module is releasably coupled to the firearm and prevents a firing mechanism of the firearm from activating a projectile a tamper interlock module comprising a wall defining a cavity, the cavity containing interlock material in a fluid state, wherein the wall is configured such that, when a predetermined force is applied to the wall the interlock material is dispensed from the cavity into the firing chamber and the interlock material at least partially transitions into a solid state such that the interlock material prevents the firing mechanism from activating the projectile;

a biometric module operably coupled to the engagement module such that, in response to receiving a signal corresponding to at least one predetermined physiological attribute, the biometric module operates the engagement module from the locked mode to an unlocked mode; and a holster comprising a holster wall defining an aperture into a holster cavity, wherein the aperture is configured such that when the firearm is inserted into the holster cavity through the aperture, and the engagement module is inserted into the firing chamber and operated into the locked mode, the engagement module resists removal of the firearm from the holster.

2. The firearm lock of claim 1, further comprising a geolocation module operably coupled to the tamper interlock module such that, in response to a signal corresponding the firearm entering a predetermined geographical region, the interlock material is dispensed from the cavity into the firing chamber.

3. The firearm lock of claim 1, wherein the wall comprises plastic, and the interlock material is dispensed in response to material failure of the wall.

4. The firearm lock of claim 1, wherein the wall comprises a region of predetermined stress concentration, and the interlock material is dispensed in response to material failure of the wall.

5. The firearm lock of claim 1, wherein the interlock material comprises a resin.

6. The firearm lock of claim 5, wherein the interlock material further comprises a hardener, and the interlock material at least partially transitions into the solid state in response to the hardener and the resin being combined.

* * * * *